US005653442A

United States Patent [19]

Abel

[11] Patent Number: 5,653,442

[45] Date of Patent: Aug. 5, 1997

[54] GAME WITH TOY PISTOL FOR MOVEMENT OF GAME PIECES ON A SUBSTRATE

[76] Inventor: Helmut Abel, 74, Boulevard d'Italie, Monte Carlo Sun, 98000, Monaco

[21] Appl. No.: 629,474

[22] Filed: Apr. 10, 1996

[30] Foreign Application Priority Data

Apr. 22, 1995 [DE] Germany ..... 195 14 934.3

[51] Int. Cl.[6] ..... A63F 7/06; A63B 71/00

[52] U.S. Cl. ..... 273/108.52; 273/119 R; 273/129 L; 273/126 R; 273/129 W; 273/108.56

[58] Field of Search ..... 273/317.7, 317.9, 273/119 R, 120 R, 120 A, 129 R, 129 K, 129 L, 129 M, 129 P, 129 Q, 129 AP, 129 S, 129 T, 129 V, 129 W, 108.5, 126 R, 318, 108.51, 108.52, 108.53, 108.54, 108.55, 108.56, 108.57

[56] References Cited

U.S. PATENT DOCUMENTS

| | | | |
|---|---|---|---|
| 2,106,625 | 1/1938 | Bodge | 273/129 W |
| 2,118,084 | 5/1938 | Heinzelmann | 273/129 W |
| 2,805,657 | 9/1957 | Shaffer | 273/129 V |
| 2,816,536 | 12/1957 | Profitt | 273/129 P |
| 2,921,792 | 1/1960 | Guss | 273/129 W |
| 3,598,411 | 8/1971 | Lippert | 273/129 W |
| 3,995,859 | 12/1976 | Goldfarb | 273/129 M |
| 4,033,584 | 7/1977 | Smith | 273/108.55 |
| 4,327,913 | 5/1982 | Bock | 273/317.7 |
| 4,533,142 | 8/1985 | Peters | 273/129 W |
| 4,949,967 | 8/1990 | Todokoro | 273/129 Q |

*Primary Examiner*—Sebastiano Passaniti
*Attorney, Agent, or Firm*—Stein, Pendorf & Van Der Wall

[57] ABSTRACT

Game including game pieces (34, 34') which can be slid over a flat upper surface of a fixed, perpendicular, triangular or polygonal substrate and including at least one game pistol moveably seatable upon the substrate (30) for selective displacement or shooting of the game pieces (34, 34') over the substrate using a strike piece (58) which is operable through a spring loaded pressure fork (42). In addition, goal like capturing basins (49) and goal devices (84) as well as glide paths (100) and capturing devices (110, 112, 116) for the game pieces can be provided.

13 Claims, 6 Drawing Sheets

FIG. 7
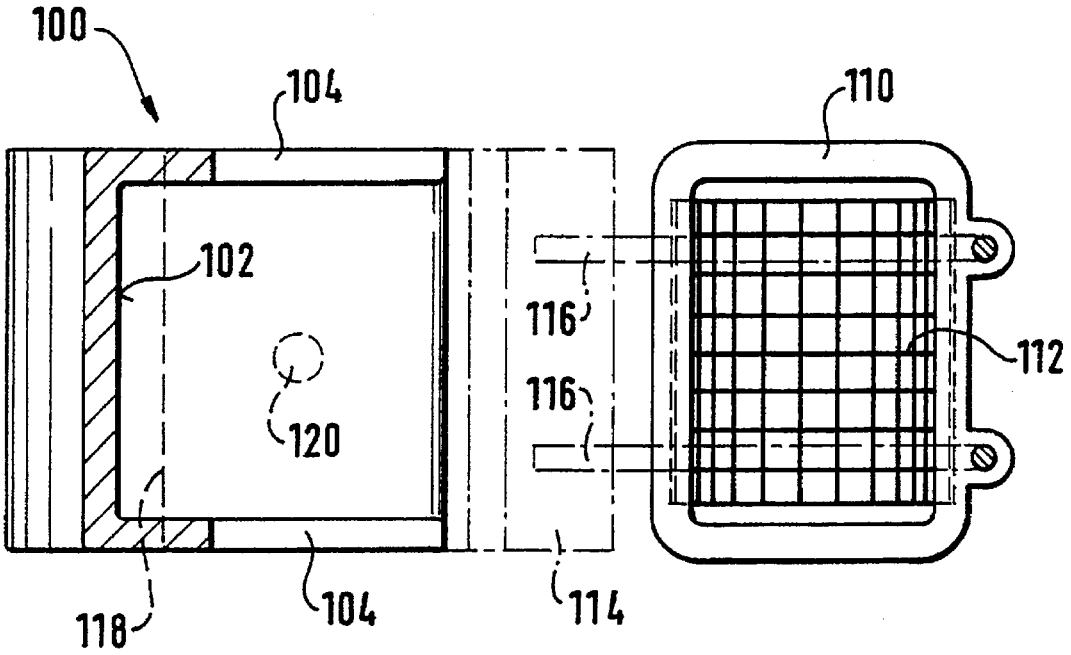
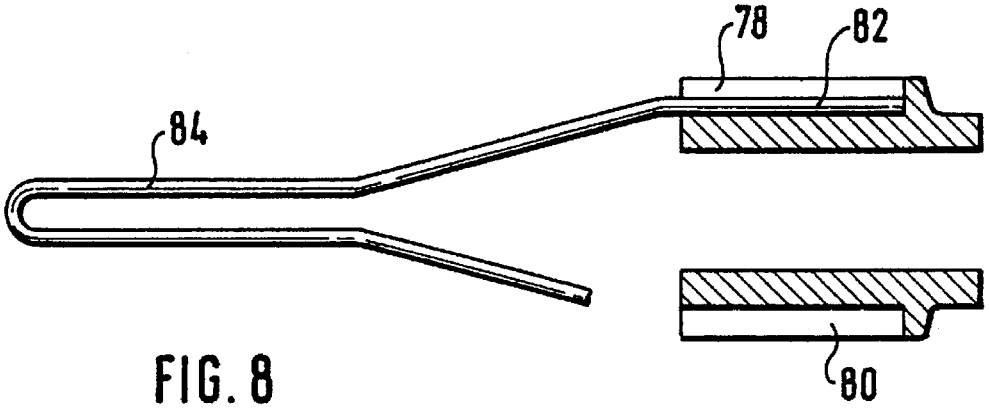
FIG. 8

GAME WITH TOY PISTOL FOR MOVEMENT OF GAME PIECES ON A SUBSTRATE

BACKGROUND OF THE INVENTION

1. Field of the Invention

The invention concerns a game including a game pistol for moving game pieces over a flat upper surface of a fixed substrate.

2. Description of the Related Art

Table top soccer games are known, in which a soccer ball shaped game piece can be pushed or shot in a particular direction by manipulating by hand a game figure superposed over a planar shaped game field towards the game piece lying on the game field, and striking the gee piece. In a number of these games a leg of the game figure can be manipulated to move and thereby achieve an striking of the game piece.

SUMMARY OF THE INVENTION

In accordance with the invention an essentially universally employable game with any number and any shape of game pieces whatever is to be provided, which has multitudinal uses and can be used with very many different game rules.

A game pistol employed according to the invention makes possible a very reliable and accurate movement of the game pieces upon the substrate. Because of its simple construction it is, on the one hand, simple and economical to produce and has, on the other hand, a great stability and durability.

Preferred embodiments of the invention include a particularly simple and useful constructions of the game pistol, a particularly preferred design for the layout of the game table, and a preferred embodiment of the game piece with respect to its shape and its materials. With regard to game pieces, two or more sets of differently colored game pieces, for example six or nine each, in the shape of flat disks, are preferred. Preferably the disks are circular cylindrical, they can however also be unround, triangular or polygonally shaped.

Further embodiments include the provision of glide paths associated with the substrate, for example the game table, along which the game pieces are to be shot, so that they climb upwardly along the glide path and there fall into a capturing device.

DETAILED DESCRIPTION OF THE INVENTION

Figure 2:
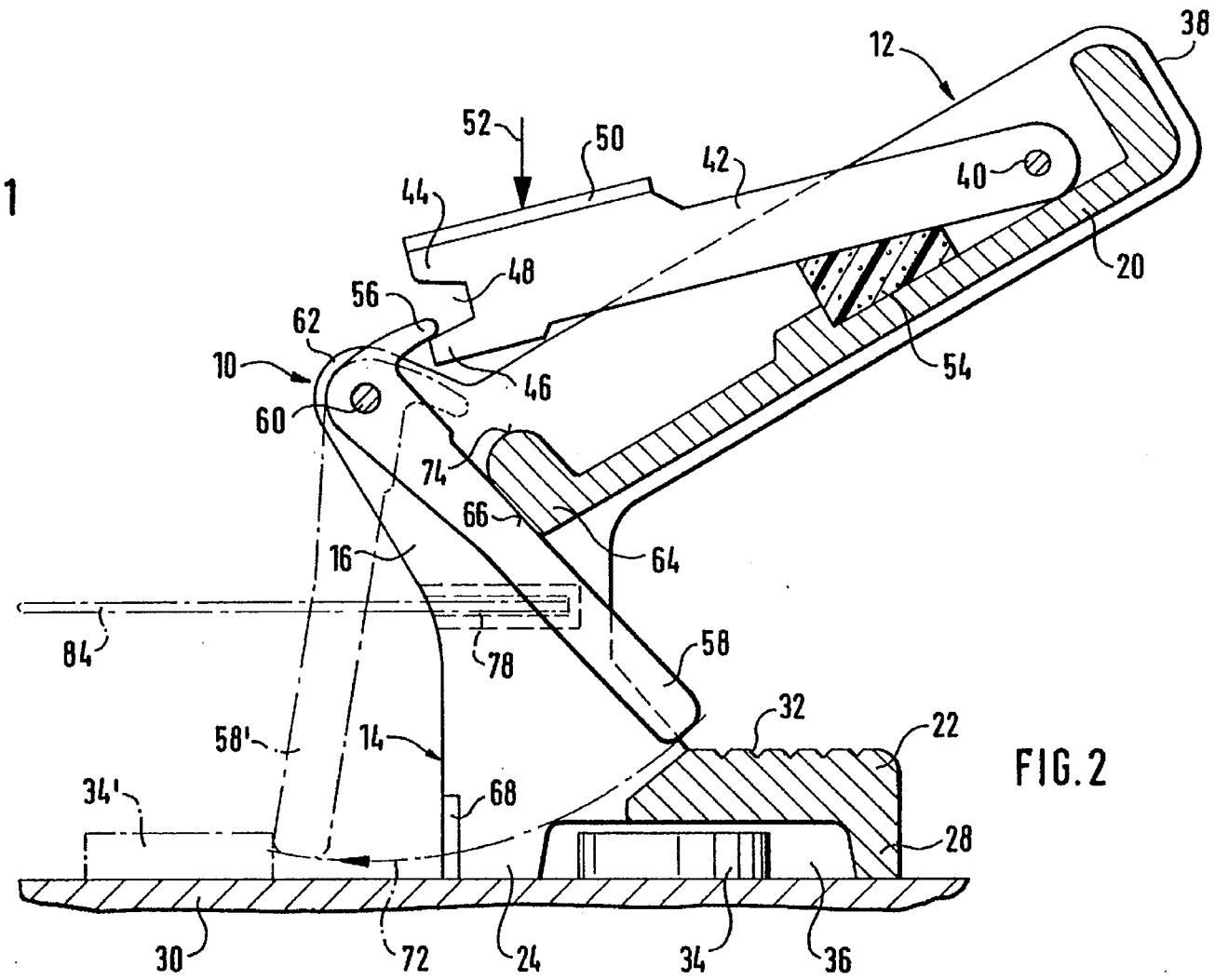
FIG. 2 a cross-section along the lines A–B in FIG. 1.
Figure 1:
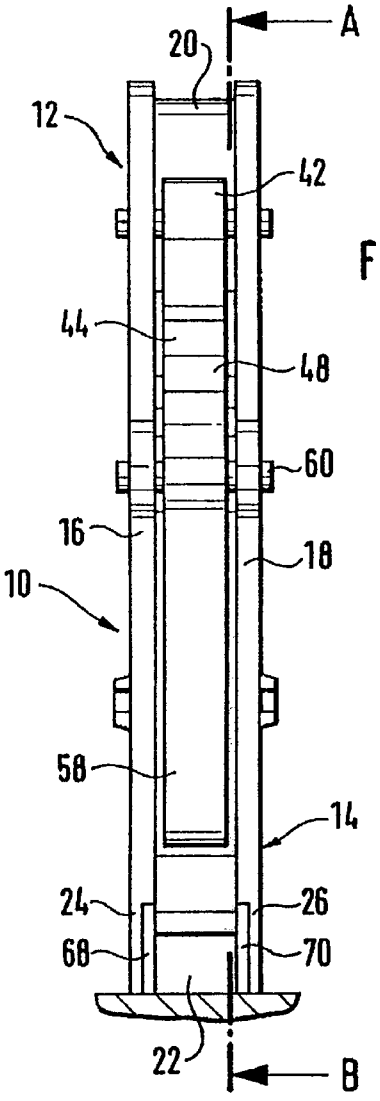
FIG. 1 a front elevation view of a game pistol as seen from the side.
Figure 4:
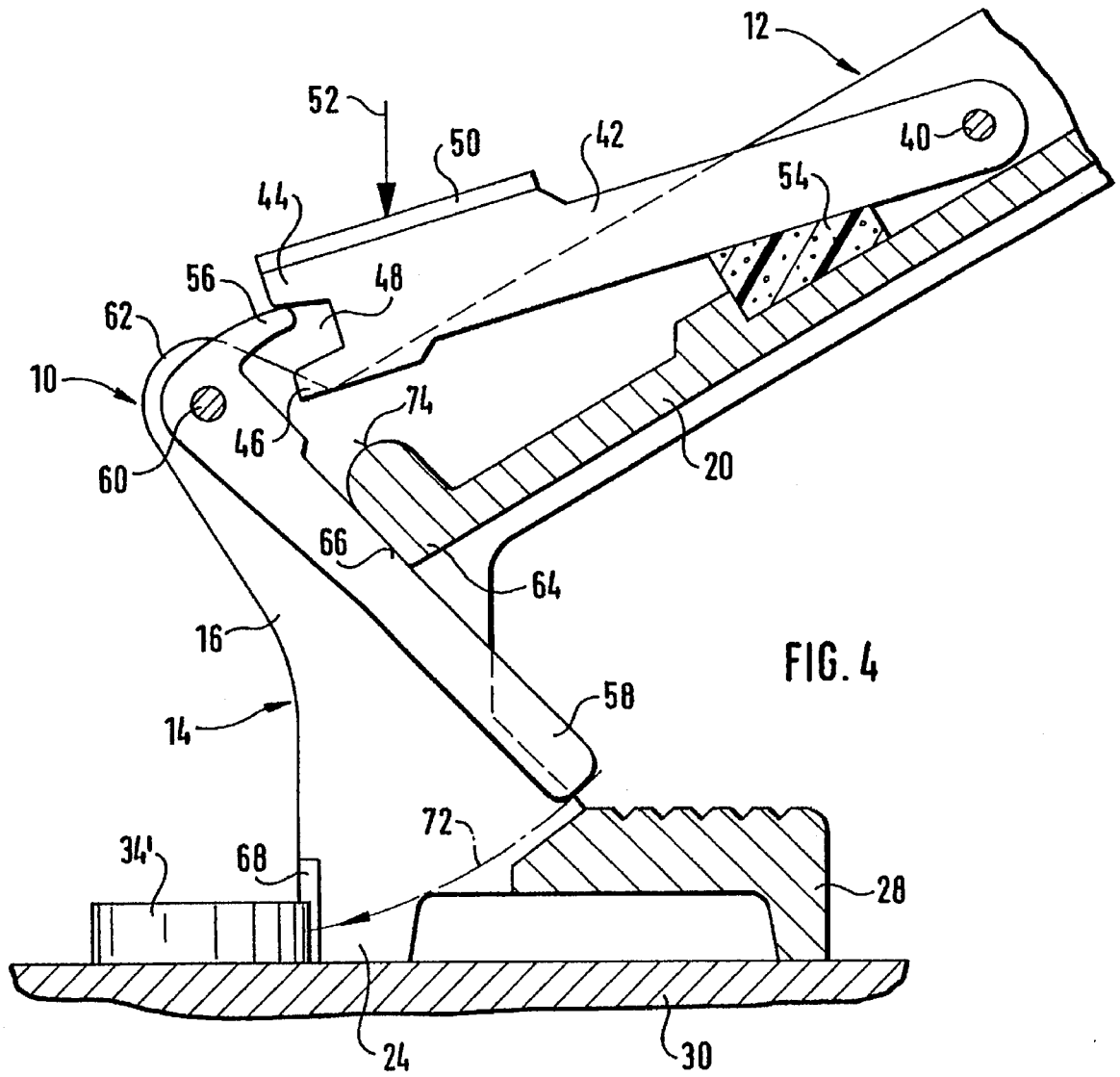

In the FIGS. 1 through 5 an illustrative example of a game pistol is shown, of which each of the players, preferably two in number, receives a specimen thereof in hand. Each game pistol includes an outer covering as generally represented with 10, which is comprised of a diagonally upwards directed grip part 12 and a somewhat diagonally downwards directed cover part 14. The outer covering 10 is comprised of two parallel side plates 16 and 18 which extend over the grip part 12 and cover part 14, as well as the spacer pieces 20 and 22 connecting the side plates. The upper spacer piece 20 extends approximately over the length of the grip part 12 and the lower distancing piece 22 perpendicularly connects the side plates 16 and 18 close to their lower ends with each other. The lower ends of the side plates 16, 18 are respectively designed as stand feet 24 or as the case may be 26. A third stand foot 28 is formed by the lower spacer piece 22. By means of the three stand feet 24, 26, 28 the game pistol can be stably stationed upon the substrate which in this illustrative example is a planar shaped game table or substrate 30 with flat upper surface. By exercising pressure upon the upper corrugated side 32 of lower spacer piece 22 a secure positioning of the game pistol on the game table 30 can be insured. A game piece which in this illustrative example is designed as a flat circular cylindrical disk 34, which lays upon the game table 30, can be bridged over by the relatively small stand feet 24, 26, 28 via a recess 36 defined between them, so that its position or lay on the table is not changed by the placement of the game pistol upon the game table 30.

Near the upper free end 38 of the grip part 12 the two side plates 16 and 18 are connected with each via a axle 40, upon which one end of a longitudinally extending pressure fork 42 is pivotally mounted. The opposite end of the pressure fork 42 is provided with two superposed fork dovetails 44 and 46, which define between them a fork opening 48. In the area of the free end of the pressure fork 42 which is provided with the fork opening 48, the upper surface of the pressure fork is provided with a rubber coating or layer 50 which dampens the pressure or impact effect on the pressure fork 42 in the sense of the arrow 52 and thereby prevents the occurrence of pain or injury by impact on the manipulating hand. In the area of the axle 40 a block shaped spring 54 of an elastomeric material is provided between the pressure fork 42 and the upper spacer piece 20, and is secured to the spacer piece 20. The spring 54 seeks to urge the pressure fork 42 upwardly, when it is compromised by the downward movement of the pressure fork 42.

Into the fork opening 48 at the free end of the pressure fork 42 there protrudes a projection 56 extends out of the side of the upper end of the longitudinal extending, substantially downwardly directed strike body 58. The strike body 58 is pivotally mounted near its upper end about axis 60, which connects the two side plates 16 and 18 in the area of a projection 62 of the same. The projection 62 of the side plates 16, 18 is oriented obliquely upwardly in the transitional area between the grip part 12 and cover part 14.

In the position shown in FIG. 2 with solid lines, the striking body 58 rests against an abutment or stop 66 in the shape a canted surface at one of the lower or inside ends 64 of the upper spacer part 20, since the projection 56 is urged upwardly by the lower fork dove tail 46 of the pressure fork 42, which is urged upwardly by spring 54. This is the so called rest position of the strike body 58 and the pressure fork 42.

Figure 3:
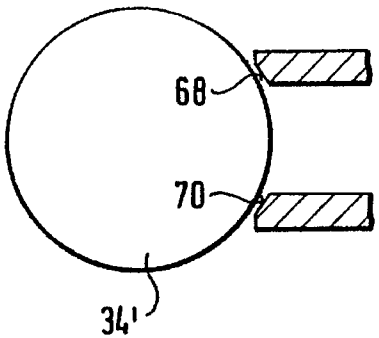
FIG. 3 a segment of a section through the lower cross section of a game pistol with associated slidable game piece, FIGS. 4 and 5 a cross section through the game pistol according to FIG. 2 in the two end- or strike- positions of the strike body or, as the case may be, pressure fork, FIG. 6 a partial section through the planar shaped substrate with capturing basin, in which an upwardly curved glide path with capturing device is provided, FIG. 7 a section along the line C–D in FIG. 6, FIG. 8 a top view of an aiming fork associated with the game pistol with sectional bordering parts of the game pistol, FIG. 9 a top view of the substrate designed as a planar shaped game table, FIG. 10 a partial sectional side view of the game table shown in FIG. 9.
Figure 5:
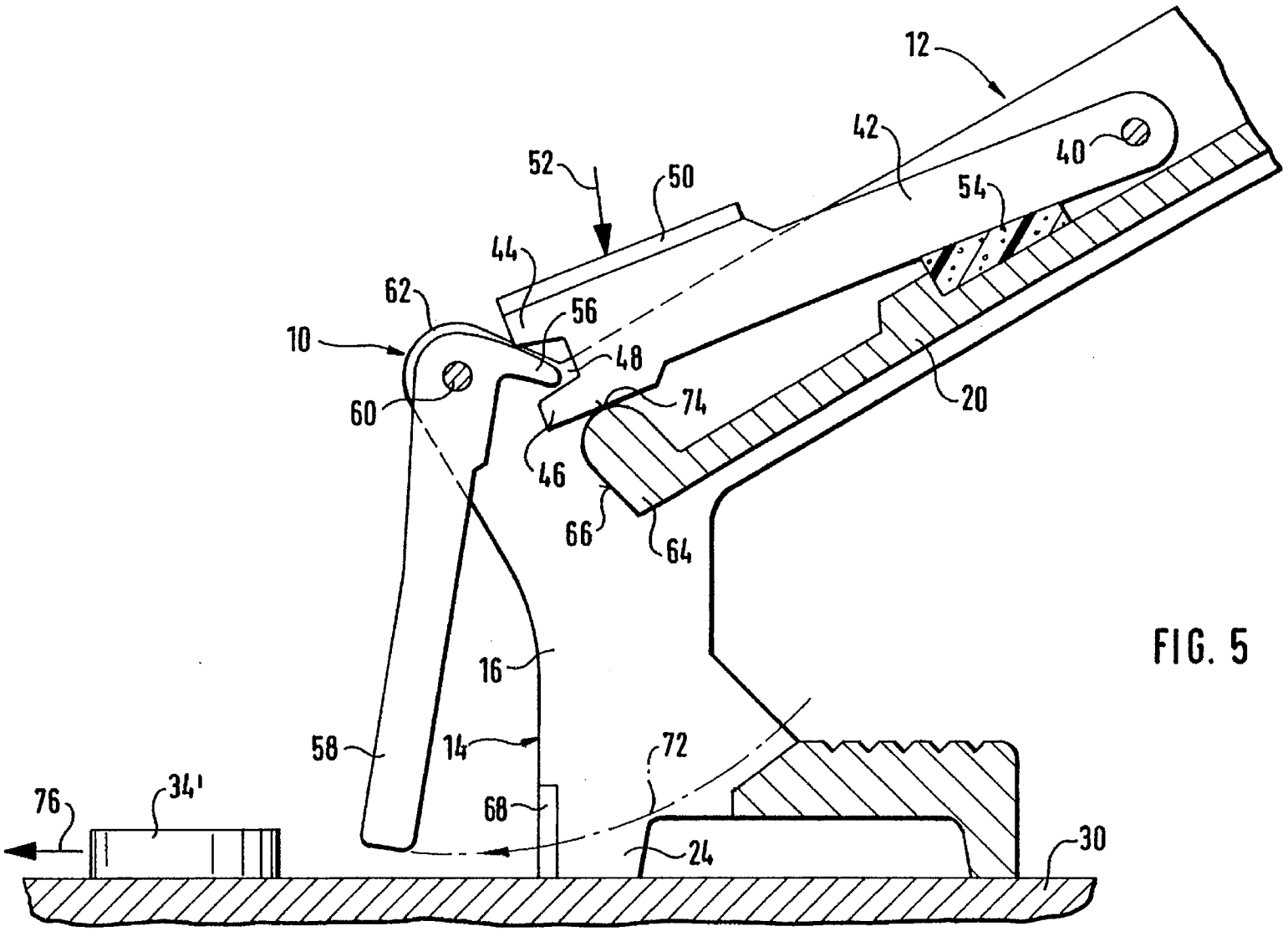

As can be seen from FIG. 3, the stand feet 24, 26 are provided at the lower end of the cover part 14 on their front most inner side are provided with bevels 68 or as the case may be 70 which serve for the precise contacting to the circumference of the game piece 34' which lies upon the game table 30. When a pressure according to arrow 52 is exerted upon the pressure fork 42, so then the upper fork dovetail 44 comes into contact with the projection 56 and urges this downwards. Thereby the strike body 58 according to arrow 72 is pivoted forwards to the position 58' indicated by dashed lines, until the lower fork dovetail 46 comes into contact with rounded off stop 74 formed by the lower inner end 64 of upper spacer part 20. This lower final position of the pressure fork 42 and at the same time the front final position of the strike body 58 are represented in FIG. 5. The beginning of the indicated pivotal movement out of the rest position of the pressure fork 42 and the strike body 58 are shown, in comparison, in FIG. 4.

Next, the game pistol is set with its two bevels 68 and 70 against the game piece 34' which is resting upon the game table 30 and then a pressing or stroke, for example with the end of the hand, according to arrow 52, is exercised upon the rubber layer or coating 50 on the pressure fork 42. If a slow shoving of the game piece 34' on the game table 30 is desired, then the exercise of pressure is exercised correspondingly slowly, while a shooting of the game piece 34' in the desired direction can be accomplished by a quick striking movement upon the pressure fork 42. The game piece 34' then distances itself quickly in the sense of the arrow 76 from the end of strike body 58 likewise accomplishing its forward movement as can be seen from FIG. 5. Upon the releasing of the pressure fork 42 the force of the spring 54 causes the pressure fork 42 and the strike body 58 to return to their beginning position or as the case may be rest position according to FIGS. 2 and 4.

In order to improve the aiming accuracy of the game pistol, the two side cover plates 16 and 18 can in the area of the cover part 14 be provided on their outer sides respectively with engagement recesses 78 and 80, in which the free ends 82, of which only one is shown in FIG. 8 in order to improve the general over view, of longitudinally extending elastic shock absorbing aiming fork 84 can be inserted. The aiming fork indicates relatively accurately the direction, in which the game piece 34 will be propelled by the strike body 58.

Figure 9:
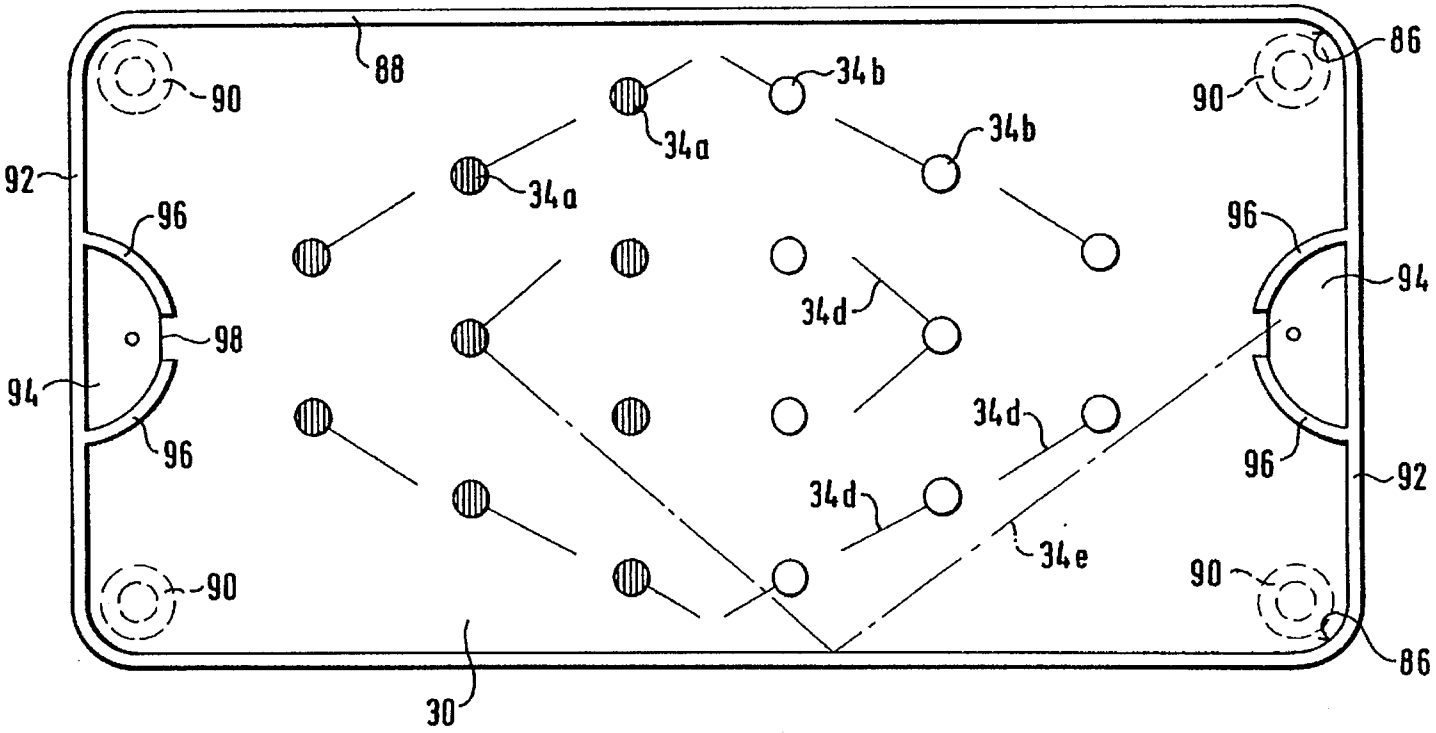
Figure 10:
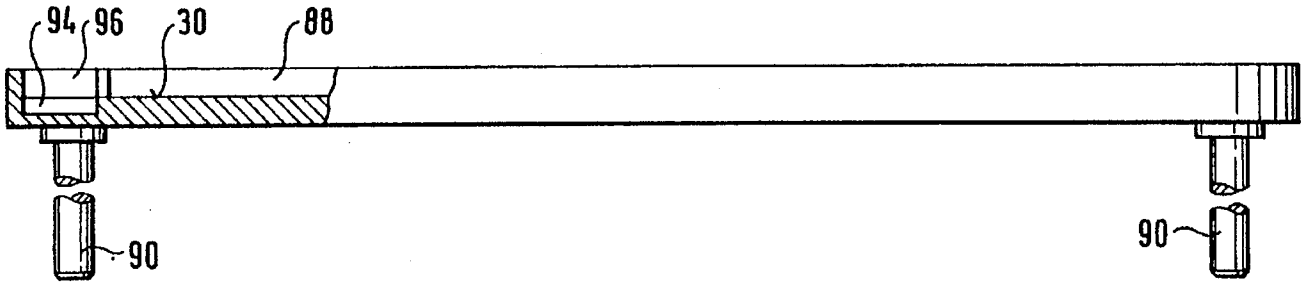

In the FIGS. 9 and 10 a particularly preferred illustrative embodiment of a game table is represented, upon which planar, perpendicular table surface 30 with flat upper surface and rounded edges 86 two different colored sets of game pieces **34*a* or as the case may be 34*b* are arranged. The game pieces 34*a*, 34*b* are, in the illustrative embodiment, constructed as flat circular cylindric disks. These can however fundamentally also be ball shaped or any desired other disk form. These game pieces are placed in circles 34*c* which are imprinted on or sprayed on the table surface 30 which correspond to the contours of the game pieces 34*a*, 34*b*. In the here represented illustrative embodiment each set 34*a*, 34*b* is comprised of nine game pieces. The game table substrate 30 is provided with an upright border 88 on all sides as well as four table legs 90. Approximately in the middle of the narrow side 92 of the table surface 30 there are provided recessed capturing basins 94 for the game pieces, which are surrounded respectively by two upwardly directed, out of the upper surface of the game table substrate 30 extending, bow shaped arms or flanges 96, which terminate on one end on the border 88 and on the other end to define a goal opening 98 therebetween. The goal opening 98 is just wide enough, that the game pieces 34*a*, 34*b* can pass therethrough to the capturing basins 94. In order to make the game easier the goal openings can also be widened somewhat. In like manner to the circles 34*c* straight target indicating lines 34*d* can be provided on the table upper surface 30, extending out from the circles 34*c*, diagonally to border 88, which can facilitate aiming of a game piece laying upon or near the circle 34*c* for banking off the border 88, for example, according to the dash line 34*e* toward the goal opening 98**.

Figure 6:
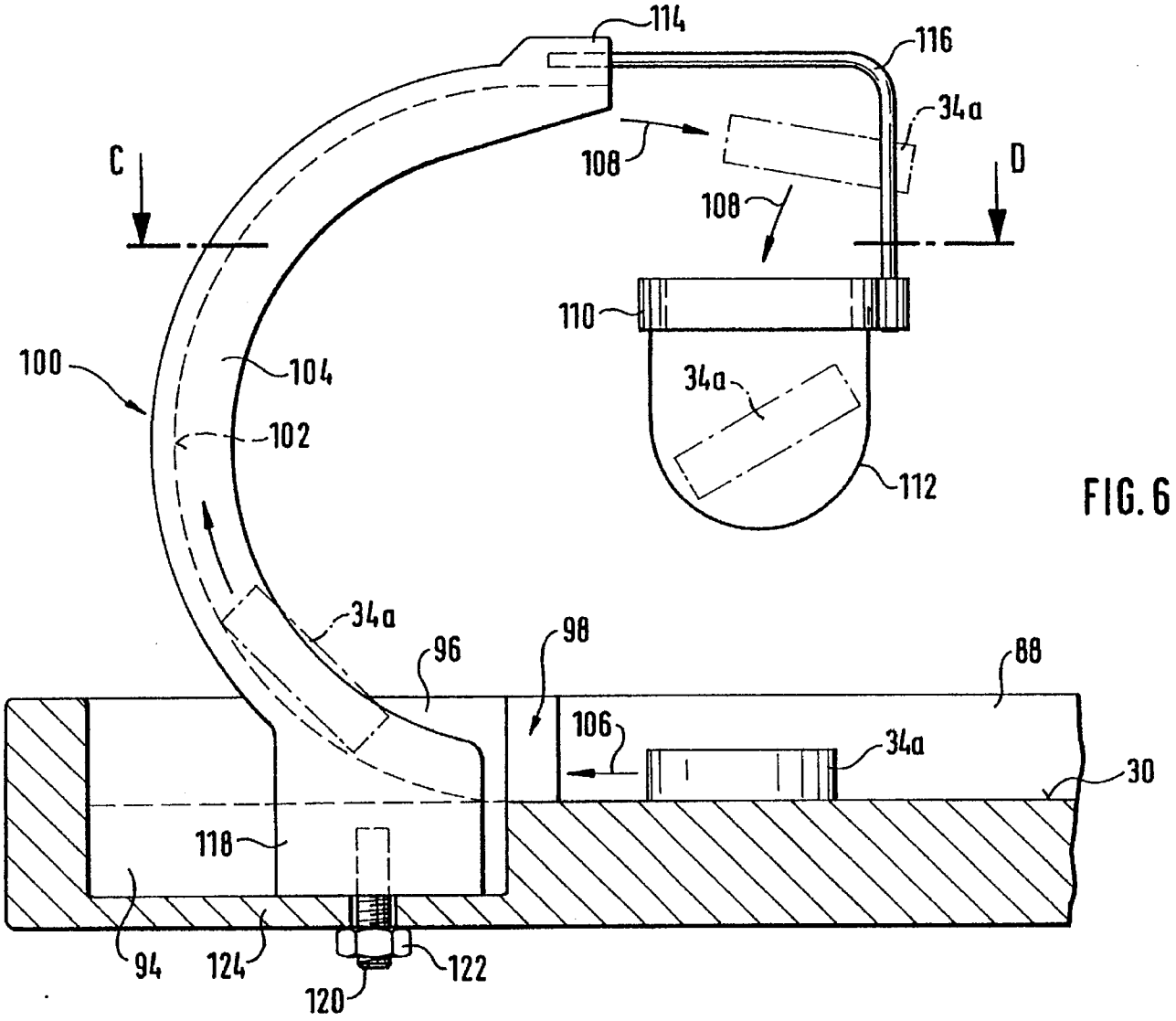

In the embodiment shown in FIGS. 6 and 7 there are additionally provided, in the area of the capturing basins 94, upwardly curved, trough shaped glide tracks, generally indicated with reference number 100. The glide track 100 is comprised of an approximately semicircular curved trough floor 102 and two relatively high side flanges 104, which make it possible to guide even game pieces 34 which enter into the glide path at an angle. The lower end of the floor 102 lies essentially connected to the upper surface of the game table 30 in the area of the goal opening 98, so that game pieces 34 which enter into the goal opening 98 according to the arrow 106, when they are imparted with sufficient impulse, can follow the glide path 100 to its upward end and according to the arrow 108 fall down into a net 112 held by an encompassing rim 110 and closed on the lower end. The rim 100, for its part, is held on the upper end 114 of glide path 100 by two parallel downwardly directed bent rods 116. The game pieces **34*a* which are guided up and around on glide path 100 crash against the inner sides of the rods 116 and fall according to arrow 108 into the net 112 as can be seen from FIG. 6. The rods 116 must for this reason have a somewhat small spacing than the cross-sectional diameter of the game pieces 34*a***.

At the bottom end of the glide path 100 two mounting structures or projections 118 are provided, which can be mounted to the floor 124 of each capturing basin 94 by means of threaded bolts 120 and nuts 122.

As can be seen from the above, the game according to the invention can be played with the most diverse game rules. For example, the object of the game can be to place the respective opponent's game pieces **34*a*, 34*b* in the opponents capturing basin 94 or, in the embodiment according to FIGS. 6 and 7, in the opponents net 112**. Besides this or in addition thereto the opponent's game pieces can be targeted and shot into the opponent's off-side area or besides this also into the opponent's capturing disk or the opponent's net.

What is claimed is:

1. Game including a fixed substrate, game pieces slidable upon said fixed substrate, and at least one moveable game pistol which can be placed upon the substrate for selective sliding or shooting of the game pieces upon the substrate, wherein said game pistol is comprised of:

an outer covering (10), which consists of a grip part (12) with a grip free end (38) directed obliquely upwardly away from the plane of said fixed substrate and a stand part (14) which can be stably positioned upon the substrate by pressing, a pressure fork (42) having a fork end and a pivotally mounted end, the pivotally mounted end pivotally mounted close to the free end (38) of the grip part (12), in which fork an opening (48) is provided on the fork end of the pressure fork (14), which opening pivotally engages a projection (56) which extends from a side of a strike part (58) which has a strike end and a pivotally mounted end, said pivotally mounted end being pivotally mounted on the grip (12) away from the end of the grip part on which pressure fork (42) is mounted, wherein the arch of movement of the strike part (58), at the point closest to the substrate (30) has a separation from the substrate, which is smaller than the height of one of the game pieces (34, 34') when lying upon the substrate, as well as a spring (54) operably provided between the grip part (12) and the pressure fork (42) for urging the pressure fork (42) away from the grip part (12).

2. Game according to claim 1, wherein the outer covering (10) is comprised of two parallel side plates (16, 18) which are securely connected to each other by upper and lower spacer pieces (20, 22), wherein the upper spacer piece (20) has approximately the longitudinal length of the grip part (12) and extends approximately parallel thereto and the lower spacer piece (22) is secured to the stand part (14).

3. Game according to claim 2, wherein the two side plates (16, 18) and the stand part (14) each respectively exhibit a stand foot (24, 26, 28) which rests on the substrate (30).

4. Game according to claim 2 or 3, wherein the side plates (16, 18) respectively exhibit seating recesses (78, 80) for seating of the fork end (82) of a longitudinally extending, elastic shock absorbing game fork (84).

5. Game according to claim 1 wherein, the substrate (30) is a game table comprised of a triangular, perpendicular, or polygonal shaped game table with rounded off edges (86), with a flat upper surface and an upwardly directed border (88) on all sides.

6. Game according to claim 5, wherein at least one side of said game table is provided with a recessed capturing basin (94) for capturing the game pieces (34, 34', **34*a*, 34*b***).

7. Game according to claim 6, wherein said at least one capturing basin (94) is partially encompassed by two straight or curved flanges (96) which project upwardly out of the game table (30), which flanges on the one side terminate at the border (88) and on the other side terminate in a goal opening (98) defined therebetween for entry of game pieces (34, 34', **34*a*, 34*b***).

8. Game according to claim 5, wherein upon the game table (30) curved or straight lines (**34*c*, 34*d*) are provided for placement or directed shooting of the game pieces (34*a*, 34*b***).

9. Game according to claim 1 therein the game pieces (34, 34', **34*a*, 34*b***) are ball-or disk-shaped.

10. Game according to claim 7, including a glide path piece, with a glide path defined therein such that the substrate (30, **30*a*) transitions to at least one upwardly curved, trough shaped glide path (100) for the game pieces (34, 34', 34*a*, 34*b*) terminating in an upper end, connected in the area of said capturing basin (94) and beginning at the goal opening (98), and wherein said upper end (114) is provided with one capturing device (110, 112, 116) for game pieces (34, 34', 34*a*, 34*b***).

11. Game according to claim 10, wherein the glide path (100) begins at the level of the table (30) and is curved upwardly approximately about 90°.

12. Game according to claim 10, wherein each said capturing device is provided with a guide device (116) for the game pieces (34, 34', **34*a*, 34*b*) exiting out of the upper end (114) of the glide path (100) and a net (112) under the guide device (116**) for receiving the game pieces.

13. Game according to claim 12, wherein the guide device (116) is comprised of two parallel rods of which the spatial separation is somewhat less than the breadth of the game pieces (34, 34', **34*a*, 34*b*) exiting out of the glide path (100**), the breadth of the game pieces being the width of the game piece when resting on the game table.

* * * * *